US010556450B2

(12) United States Patent
Seguchi et al.

(10) Patent No.: US 10,556,450 B2
(45) Date of Patent: Feb. 11, 2020

(54) INK JET RECORDING METHOD AND INK JET RECORDING APPARATUS

(71) Applicant: Seiko Epson Corporation, Tokyo (JP)

(72) Inventors: Kenichi Seguchi, Okaya (JP); Mitsuaki Kosaka, Minowa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/174,455

(22) Filed: Oct. 30, 2018

(65) Prior Publication Data

US 2019/0126639 A1 May 2, 2019

(30) Foreign Application Priority Data

Oct. 31, 2017 (JP) ..... 2017-210026

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 2/2114; B41J 11/002; B41J 11/00; B41J 11/0015
See application file for complete search history.

(56) References Cited

U.S. PATENT DOCUMENTS

2015/0091974 A1* 4/2015 Aoyama et al. ..... B41J 11/0015
2015/0252200 A1 9/2015 Kagata et al.

FOREIGN PATENT DOCUMENTS

JP 2015-168805 A 9/2015

* cited by examiner

*Primary Examiner* — Juanita D Jackson
(74) *Attorney, Agent, or Firm* — Harness, Dickey & Pierce, P.L.C.

(57) ABSTRACT

An ink jet recording method includes heating a recording medium, and attaching an aqueous ink composition to the heated recording medium by ejecting the aqueous ink composition through a nozzle. The aqueous ink composition contains water, a solvent, and resin particles. In the attaching step, a temperature difference between a temperature of the nozzle and a surface temperature of the heated recording medium is −4 to 8° C. The resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture containing the solvent contained in the aqueous ink composition and the particular resin particles such that a resin solid component of the liquid mixture is 0.5% by mass.

20 Claims, 2 Drawing Sheets

INK JET RECORDING METHOD AND INK JET RECORDING APPARATUS

BACKGROUND

1. Technical Field

The present invention relates to an ink jet recording method and an ink jet recording apparatus.

2. Related Art

Ink jet recording methods are being rapidly developed in various fields because a high definition image can be recorded by a relatively simple apparatus. During this development, various studies have been conducted on the balance between abrasion resistance and clogging. For example, JP-A-2015-168805 aims to provide an ink composition that is excellent in abrasion resistance, suppresses short-term and long-term clogging, and has improved ejection stability, and discloses an ink composition containing colorant, water, and polymer particles. The polymer particles have a core-shell structure including a core polymer and a shell polymer. The glass transition temperature of the core polymer is lower than 60° C., and the glass transition temperature of the shell polymer is 60° C. or higher. The acid value of the polymer particles is 50 mgKOH/g or higher, and the shell polymer contains an aromatic monomer as a constituent.

However, when trying to further improve the image quality by more quickly drying the ink applied in an ink attaching step, a heater is used to apply additional heat to the recording medium. As a result, an even better anti-clogging property is being demanded.

SUMMARY

In view of the object described above, an advantage of some aspects of the invention is to provide an ink jet recording method and an ink jet recording apparatus which are excellent in the image quality, the anti-clogging, and the abrasion resistance and in which a hitting (target) position deviation is less likely to occur.

The inventors have carried out an intensive study to solve the problem described above. As a result, the inventors have found that the problem described above can be solved by using a predetermined ink composition while adjusting a temperature difference between the surface temperature of a recording medium and the temperature of a nozzle.

According to an aspect of the invention, an ink jet recording method includes heating a recording medium, and attaching an aqueous ink composition to the recording medium heated in the heating by ejecting the aqueous ink composition through a nozzle, the aqueous ink composition containing water, a solvent, and resin particles. In the attaching, a temperature difference between a temperature of the nozzle and a surface temperature of the recording medium is −4 to 8° C. The resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture containing the solvent contained in the aqueous ink composition and the particular resin particles such that a resin solid component of the liquid mixture is 0.5% by mass. As a result, high image quality and a high anti-clogging property can be achieved at the same time. This is also preferable from the viewpoint of recording apparatus design. In addition, a hitting position deviation can be suppressed, and a recorded product excellent in the abrasion resistance can be obtained. Further, an excellent optical density (OD) value can be obtained.

Further, according to another aspect of the invention, an ink jet recording method includes heating a recording medium, and attaching an aqueous ink composition to the recording medium heated in the heating by ejecting the aqueous ink composition through a nozzle, the aqueous ink composition containing water, a solvent, and resin particles. In the attaching, a temperature difference between a temperature of the nozzle and a surface temperature of the recording medium is −4 to 8° C. The resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture in which the particular resin particles are mixed in a solvent composition containing 2-pyrrolidone and propylene glycol in a mass ratio of 7:3 such that a resin solid component of the liquid mixture is 0.5% by mass. As a result, high image quality and a high anti-clogging property can be achieved at the same time. This is also preferable from the viewpoint of recording apparatus design. In addition, a hitting position deviation can be suppressed, and a recorded product excellent in the abrasion resistance can be obtained. Further, an excellent optical density (OD) value can be obtained.

Further, the ink jet recording method of the invention may include elements described in the claims in addition to the ink jet recording methods according to the aspects of the invention.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
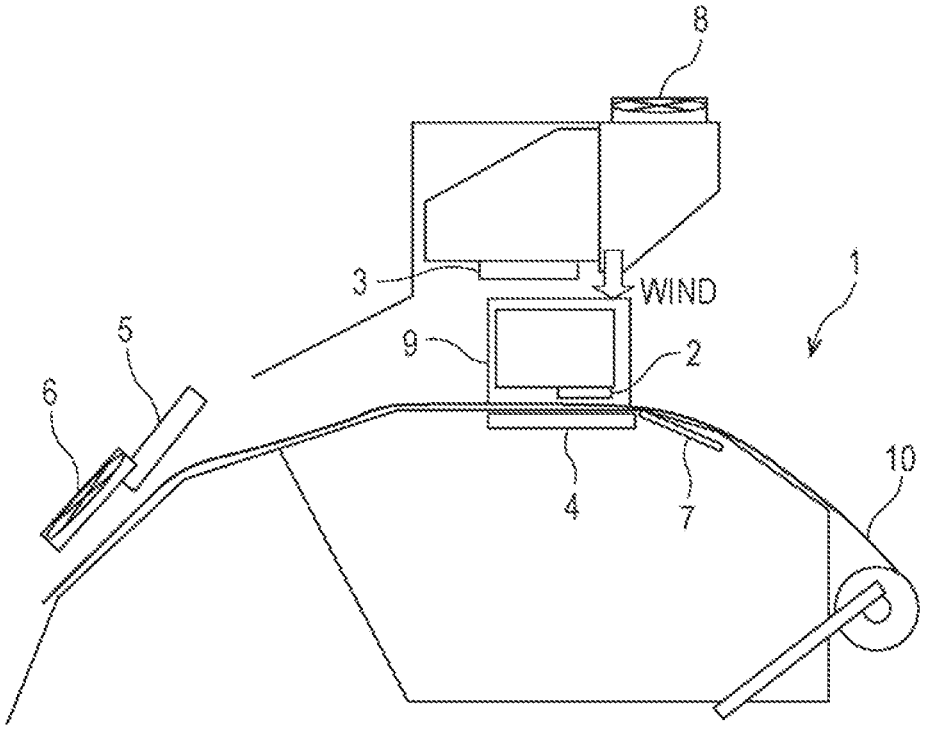
FIG. 1 is a schematic section view of a recording apparatus according to an embodiment illustrating a configuration thereof.

Although an embodiment (hereinafter referred to as "present embodiment") of the invention will be described in detail below with reference to drawings, the invention is not limited to this description and illustration, and can be modified in various ways within the scope of the invention. To be noted, in the drawings, the same elements are denoted by the same reference signs, and redundant descriptions will be omitted. In addition, positional relationships between up, down, left, and right is based on the positional relationship in the drawings unless otherwise particularly described. Further, the dimensional ratios in the drawings are not limited to the illustrated ratios. To be noted, in this description, "(meth)acrylate" stands for both of acrylate and methacrylate corresponding thereto.

Ink Jet Recording Method

An ink jet recording method of the present embodiment includes heating a recording medium, and attaching (applying) an aqueous ink composition to the heated recording medium by ejecting the aqueous ink composition through a nozzle, the aqueous ink composition containing water, a solvent, and resin particles. In the attaching (e.g., during the attachment/application step), a temperature difference between a temperature of the nozzle and a surface temperature of the recording medium is −4 to 8° C. The resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture containing the solvent contained in the aqueous ink composition and the particular resin particles such that a resin solid component of the liquid mixture is 0.5% by mass.

Heating Step

A heating step is a step of heating the recording medium. Although the particular heating method employed is not particularly limited, it is preferable to use one or more processes selected from, for example, a conduction system of conducting heat to the recording medium from a member such as a recording medium support portion that comes into contact with the recording medium, a wind (air) blowing system of blowing heated air to the recording medium by an air blowing unit such as a fan, and a radiation system of radiating a heat-generating radiation ray such as infrared light (IR) onto the recording medium. From the viewpoint of securing better image quality and the like, it is preferable that an ink attaching step is performed on the recording medium that has been heated in the heating step and has a temperature higher than a normal (e.g., unheated/ambient) temperature. The heating step is preferably performed before or in parallel with (simultaneously with) attachment of the ink composition.

As an example of the conduction system, the heating step can be performed by a platen heater or a preheater. The surface temperature of the recording medium during the ink attaching step that will be described later is preferably 30° C. or higher, more preferably 32° C. or higher, and further preferably 35° C. or higher. In addition, the surface temperature of the recording medium in the ink attaching step that will be described later is preferably 46° C. or lower, more preferably 40° C. or lower, and further preferably 38° C. or lower. By heating the recording medium, the clogging that might be caused by, for example, resin solidifying and adhering inside a nozzle is suppressed, and, since the ink that has hit the recording medium in the subsequent ink attaching step is more likely to dry, the image quality of the resulting recorded product tends to be improved. Particularly, as a result of the surface temperature being 30° C. or higher, the embeddability of dots of the ink composition on the recording medium, particularly on an unabsorbent recording medium such as vinyl chloride, tends to be better, and the image quality tends to be better. In addition, as a result of the surface temperature being 46° C. or lower, unwanted heating of an ink jet head (nozzle) is suppressed, and thus the anti-clogging property tends to be improved.

Recording Medium

The recording medium used in the ink jet recording method of the present embodiment is not particularly limited, and examples thereof include absorbent recording media, unabsorbent recording media, and low-absorbency recording media. Among these, a low-absorbency recording medium or an unabsorbent recording media is preferably used, and an unabsorbent recording media is more preferably used. In the unabsorbent recording medium or the low-absorbency recording medium, the embeddability is more likely to decrease due to repellency of the aqueous ink composition when the absorbency is lower. Therefore, the ink jet recording method according to the present embodiment is advantageous when used on such a recording medium.

Here, the "low-absorbency recording medium" and the "unabsorbent recording medium" are recording media whose water absorption amount from contact to 30 msec is 10 mL/m$^2$ or smaller according to the Bristow method. The Bristow method is a measurement method for liquid absorption amount in a short period that is the most widely used, and is also employed by Japan Technical Association of the Pulp and Paper Industry (JAPAN TAPPI). The details of this measurement method are described in standard No. 51 "Paper and Cardboard—Liquid Absorption Measurement Method—Bristow Method" of "JAPAN TAPPI Paper and Pulp Measurement Method, ver. 2000".

In addition, the unabsorbent recording medium and the low-absorbency recording medium can also be classified by wettability for water on a recording surface. For example, the recording medium can be characterized by dripping a water droplet of 0.5 μL on a recording surface of the recording medium and measuring the decrease rate of contact angle (comparison between the contact angles at 0.5 msec and 5 sec after hitting). More specifically, regarding characteristics of the recording medium, "unabsorbent" of "unabsorbent recording medium" indicates that the above-described decrease rate is lower than 1%, and "low-absorbency" of "low-absorbency recording medium" indicates that the above-described decrease rate is 1% or higher and lower than 5%. In addition, "absorbent" indicates that the above-described decrease rate is 5% or higher. To be noted, the contact angle can be measured by using, for example, a portable contact angle meter PCA-1 (manufactured by Kyowa Interface Science Co., Ltd.).

The low-absorbency recording medium is not particularly limited, and examples thereof include coated paper provided with a coating layer for receiving an oily ink on the surface thereof. The coated paper is not particularly limited, and examples thereof include recording paper such as art paper and matte paper.

The unabsorbent recording medium is not particularly limited, and examples thereof include a plastic film not including an ink absorbing layer, and a recording medium in which a substrate such as paper is coated with plastics or a plastic film is bonded to the substrate. Examples of the plastics mentioned herein include polyvinyl chloride, polyethylene terephthalate, polycarbonate, polystyrene, polyurethane, polyethylene, and polypropylene.

Ink Attaching Step

The ink attaching step is a step of attaching (applying) an aqueous ink composition containing water, a solvent, and resin particles to the recording medium heated in the heating step by ejecting the aqueous ink composition through a nozzle (or nozzles). The ejection method of the aqueous ink composition is not particularly limited and a conventionally known method can be used, and examples thereof include ejecting a droplet by using vibration of a piezoelectric element, that is, forming an ink droplet by mechanical deformation of an electrostrictive element.

In the ink attaching step, a temperature difference between the temperature of the nozzle and the surface temperature of the recording medium (temperature of the nozzle minus the surface temperature of the recording medium) is −4° C. or higher, preferably −2° C. or higher, more preferably 0° C. or higher, further preferably 1° C. or higher, and particularly preferably 3° C. or higher. As a result of the temperature difference being −4° C. or higher, the image quality of the obtained recorded product can be improved, control for reducing the temperature of the nozzle for suppressing excessive increase of the temperature of the nozzle caused by the heat in the heating step can be minimized, and therefore a hitting position deviation can be further suppressed, and the flexibility of the recording method design can be improved.

Meanwhile, the temperature difference between the temperature of the nozzle and the surface temperature of the recording medium is 8° C. or lower, preferably 4° C. or lower, more preferably 0° C. or lower, further preferably −1° C. or lower, and particularly preferably −2° C. or lower. As a result of the temperature difference being 8° C. or lower, clogging due to resin solidifying and adhering inside the nozzle can be further suppressed.

The temperature of the nozzle is preferably 55° C. or lower, more preferably 50° C. or lower, further preferably 45° C. or lower, particularly preferably 43° C. or lower, and even more preferably 40° C. or lower. Meanwhile, the temperature of the nozzle is preferably 30° C. or higher, more preferably 35° C. or higher, and further preferably 37° C. or higher.

As a result of the temperature of the nozzle being within the range described above, clogging due to resin solidifying and adhering inside the nozzle tend to be further suppressed.

Adjustment of the temperature difference and temperatures described above can be performed by a method such as controlling, by adjusting the distance between the recording medium and the nozzle, the effect of the nozzle being indirectly heated by the heated recording medium, additionally providing an air blowing unit to cool the nozzle, or additionally providing a heater to heat the nozzle.

The distance between the nozzle surface of the nozzle and the surface of the recording medium is preferably 0.5 to 3 mm, more preferably 0.7 to 2.5 mm, further preferably 1 to 2 mm, and particularly preferably 1.3 to 1.8 mm. As a result of the distance between the nozzle surface of the nozzle and the surface of the recording medium being 3 mm or smaller, the hitting position deviation tends to be suppressed. In addition, as a result of the distance between the nozzle surface of the nozzle and the surface of the recording medium being 0.5 mm or larger, the clogging tends to be suppressed.

Air Blowing Step

In the ink attaching step, an air blowing step of blowing air to a region on the recording medium to which the ink composition is attached may be preferably performed. Examples of the air blowing include blowing air against the surface of the recording medium and also include blowing air parallel to the surface of the recording medium. The air blowing is preferably performed on a recording region on the recording medium to which ink is already attached. The air blowing can remove a component of the ink composition that has evaporated from the recording region, accelerates drying of the ink composition, achieves a better image quality and a better OD (optical density) value, and is thus preferable. The air blowing may be performed by an air blowing unit such as a fan.

In addition, by blowing air, it becomes possible to adjust the temperature difference to be within a predetermined range even in the case where the distance between the nozzle surface of the nozzle and the surface of the recording medium is shortened, and thus clogging can be suppressed, hitting position deviation can be suppressed, and image quality can be improved. In addition, when the aqueous ink composition is ejected through the nozzle, sometimes a mist derived from the ink composition is generated in the space between the nozzle surface and the surface of the recording medium. The mist can attach to a nozzle plate to contribute to hitting position deviation and deterioration of the anti-clogging property, and can decrease drying speed of the ink composition on the recording medium to cause deterioration of image quality by, for example, causing blur. By blowing air on or over the recording medium, such a mist can be removed. The air blowing step may be performed as the heating step of the air blowing system described above, or may be performed as a step separate from the heating step.

The air speed of the air across the surface of the recording medium is preferably 0.5 m/sec or higher, more preferably 1 m/sec or higher, and further preferably 1.5 m/sec or higher. Clogging tends to be suppressed more when the air speed of the air passing over or projected onto the surface of the recording medium is 0.5 m/sec or higher. In addition, the air speed of the air on the surface of the recording medium is preferably 5 m/sec or lower, more preferably 4 m/sec or lower, and further preferably 3 m/sec or lower. Hitting position deviation tends to be suppressed more and the image quality tends to be improved more when the air speed of the air on the surface of the recording medium is 5 m/sec or lower. Further, the temperature of the air is preferably 45° C. or lower, more preferably 40° C. or lower, further preferably 35° C. or lower, yet further preferably 30° C. or lower, and still further preferably 27° C. or lower. Clogging tends to be suppressed more when the temperature of the air is 45° C. or lower. In addition, the temperature of the air is preferably 20° C. or higher. The anti-clogging property and the image quality tend to be improved more when the temperature of the air is 20° C. or higher. In the case of setting the temperature of the air to a temperature higher than the ambient temperature, air heated by a heater can be used as the air. Meanwhile, air not heated by a heater, that is, room temperature air may be also used as the air.

The air speed can be measured in the case where the air blows parallel to the surface of the recording medium. In addition, in the case of blowing the air against the surface of the recording medium, the air speed can be measured at a position on the upstream side of the air, for example, near a position at which the air is blown out from an air outlet. For example, the air speed can be measured at a position near the air outlet (near the word "WIND" in FIG. 1) through which the air blows out from a housing accommodating the fan 8 in FIGS. 1, 2A, and 2B. Further, the temperature of the air is measured at a position spaced apart from the recording medium so as not to be affected by a heat source such as the surface of the recording medium. Specifically, for example, the temperature of the air can be measured near the air outlet.

Aqueous Ink Composition

The aqueous ink composition contains water, a solvent, and resin particles, and may contain a colorant, a surfactant, and a pigment dispersant as desired. To be noted, in the present description, "solvent" refers to a solvent other than water. Each component will be described below. The aqueous ink composition contains water as one of main solvent components. The content of water in the composition is preferably 40% by mass or more, more preferably 50% by mass or more, further preferably 60% by mass or more, and, although the upper limit is not limited, preferably 98% by mass or less.

Resin Particles

The resin particles have an effect of improving the abrasion resistance of the image by forming a resin coating film on the recording medium to sufficiently fix the aqueous ink composition on the recording medium. The resin coating film can protect pigment and develop an adhesion property and abrasion resistance on the recording medium.

In the present embodiment, the resin particles include particular resin particles formed from a resin whose decrease rate of absorbance of light having a wavelength of 400 nm is 15% or lower in 1 hour at 40° C. and 10% or higher in 1 hour at 80° C. when the liquid mixture contains the solvent contained in the aqueous ink composition and the particular resin particles such that a resin solid component of the liquid mixture is 0.5% by mass.

To be noted, the decrease rate of absorbance of light having a wavelength of 400 nm in 1 hour at 40° C. is 15% or lower, preferably lower than 15%, more preferably 12.5% or lower, further preferably 10% or lower, and still further preferably 5% or lower. As a result of the decrease rate of absorbance of light having a wavelength of 400 nm in 1 hour at 40° C. being 15% or lower, clogging is further suppressed. The lower limit value of the decrease rate of absorbance of light having a wavelength of 400 nm in 1 hour at 40° C. is not particularly limited, and can be 0% or higher, preferably 1% or higher. The reason why the anti-clogging property is good when the decrease rate of absorbance of light having a wavelength of 400 nm in 1 hour at 40° C. is within the range described above is believed to be as follows. This is because, in the case where the resin particles dissolve in a state in which water is dried up first and an organic solvent contained in the ink composition is concentrated when a head receives heat and drying of the ink composition in a head or near the nozzle progresses, the dissolved resin is likely to adhere inside the head and near the nozzle, and the adhered resin is not likely to be removed even when the ink flows in the head and the nozzle, causing clogging. Therefore, the anti-clogging property is good in the case where the resin is less dissolved.

In addition, the decrease rate of absorbance of light having a wavelength of 400 nm in 1 hour at 80° C. is 10% or higher, preferably 11% or higher, more preferably 12% or higher, further preferably 15% or higher, particularly preferably 20% or higher, and even more preferably 30% or higher. The upper limit value of the decrease rate of absorbance of light having a wavelength of 400 nm in 1 hour at 80° C. is not particularly limited, and can be 60% or lower. As a result of the decrease rate of absorbance of light having a wavelength of 400 nm in 1 hour at 80° C. being 10% or higher, the abrasion resistance and the OD value of the resulting recorded product are improved more. The reason why the abrasion resistance is good when the decrease rate of absorbance of light having a wavelength of 400 nm in 1 hour at 80° C. is within the range described above is believed to be because, in the case where the resin particles are likely to dissolve in the organic solvent remaining after the water dries up first in a post-drying step after attaching the ink composition to the recording medium, the resin quickly forms a sufficiently smooth film on the recording medium and thus firmness of contact with the recording medium is improved.

The decrease rate of absorbance of light having a wavelength of 400 nm in 1 hour at 40° C. and the decrease rate of absorbance of light having a wavelength of 400 nm in 1 hour at 80° C. can be adjusted by the combination of the kind of the resin particles and the composition of the solvent. For example, adjustment of the kind of the resin particles can be performed by adjusting the glass transition temperature, the degree of crosslinking, and the composition such as the kind and amount of the monomer used for synthesizing the resin. For example, adjustment of the composition of the solvent can be performed by, in the case where a single kind of solvent is used, adjusting the polarity or the like of the solvent, and, in the case where a composite solvent of two or more kinds is used, by adjusting the combination of solvents, the ratio of the combination, and the like. In addition, a method of preparing resin particles formed from a homopolymer constituted only by each one of monomers constituting the resin particles, measuring the decrease rate of absorbance described above in the solvent composition of the resin particles, grasping the tendency of the decrease rate of the absorbance of each monomer from the results, and selecting the kinds and ratio of the monomers to be used to achieve the aimed decrease rate of absorbance to design resin particles formed from a copolymer constituted by a plurality of kinds of monomers by may be used.

Measurement of the decrease rate of absorbance of light having a wavelength of 400 nm in 1 hour at 40° C. and the decrease rate of absorbance of light having a wavelength of 400 nm in 1 hour at 80° C. can be performed by first preparing 100 g of a liquid mixture containing the same resin particles in a solution of the same solvent composition in a resin solid component of 0.5% by mass on the basis of the combination of the resin particles and the solvent composition used in the aqueous ink composition. To be noted, the resin particles may be isolated and used in the case where the resin particles can be isolated from the ink, or resin particles before preparing the ink may be used. The liquid mixture obtained in this manner is sealed in a glass container and left to stand for 1 hour at 25° C., and absorbance Abs25 after the stand is measured. In addition, separately, absorbance Abs40 after leaving the liquid mixture to stand for 1 hour at 40° C. and absorbance Abs80 after leaving the liquid mixture to stand for 1 hour at 80° C. are measured in a similar manner. To be noted, the liquid mixture after the stand is subjected to measurement after once returning the liquid mixture to the state of 25° C., vertically shaking the glass container 10 times, and leaving the liquid mixture to stand for 1 minute. The absorbance of light having a wavelength of 400 nm can be measured by using an absorbance meter (U-3900H manufactured by Hitachi High-Tech Science Corporation, measurement mode: wavelength scan, scan speed: 600 nm/min). The decrease rate (%) of absorbance in 1 hour stand at 40° C. and the decrease rate (%) of absorbance in 1 hour stand at 80° C. can be calculated in accordance with the following formulae.

$$\text{Decrease rate of absorbance in 1 hour stand at 40° C.} = (1-(Abs40/Abs25))\times 100$$

$$\text{Decrease rate of absorbance in 1 hour stand at 80° C.} = (1-(Abs80/Abs25))\times 100$$

To be noted, the absorbance of light having a wavelength of 400 nm is an index indicating solubility of the resin particles. When the resin particles are dissolved, the liquid mixture becomes clear and the absorbance relatively decreases, and when the resin particles are not dissolved, the resin particles remain in a dispersed state, and the absorbance remains relatively high.

As described above, in the case of a condition in which the decrease rate of absorbance of light having a wavelength of 400 nm in 1 hour at 40° C. is low (the resin particles are not likely to dissolve before ejection) and the decrease rate of absorbance of light having a wavelength of 400 nm in 1 hour at 80° C. is high (the resin particles are likely to dissolve in a heated state after ejection), clogging and hitting position deviation are suppressed, the resin particles are likely to form a coating film after recording, and the abrasion resistance of the recorded product tends to improve more.

To be noted, the absorbance of light having a wavelength of 400 nm at 40° C. is preferably 1 to 4, and more preferably 1.5 to 3.5. The absorbance of light having a wavelength of 400 nm at 80° C. is preferably 0.5 to 3.5, and more preferably 1 to 3. Further, the absorbance of light having a wavelength of 400 nm at 25° C. is preferably 1 to 4, and more preferably 1.5 to 3.5.

In addition, as another aspect (second embodiment) of the present embodiment, a mixture solvent prepared in a ratio of 2-pyrrolidone:propylene glycol=7:3 may be used instead of the solution emulating the solvent composition of the aqueous ink composition in measurement of the decrease rate of absorbance of light having a wavelength of 400 nm. The absorbance after leaving the liquid mixture to stand at each temperature and the decrease rate based thereon in this case can be similar to those described above.

The ink jet recording method according to the second embodiment includes heating a recording medium, and attaching an aqueous ink composition to the recording medium heated in the heating by ejecting the aqueous ink composition through a nozzle, the aqueous ink composition containing water, a solvent, and resin particles. In the attaching, a temperature difference between a temperature of the nozzle and a surface temperature of the recording medium is −4 to 8° C. The resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture in which the particular resin particles are mixed in a solvent composition containing 2-pyrrolidone and propylene glycol in a mass ratio of 7:3 such that a resin solid component of the liquid mixture is 0.5% by mass. As a result, high image quality, a high anti-clogging property, and high abrasion resistance can be obtained, and hitting position deviation can be suppressed.

The embodiment that is described above or will be described later and is different from the second embodiment serves as a first embodiment. The ink jet recording method of the second embodiment can be independent from and the same as the ink jet recording method of the first embodiment except that the mixture solvent prepared in the ratio of 2-pyrrolidone:propylene glycol=7:3 is used in measurement of the decrease rate of absorbance of light having a wavelength of 400 nm instead of the solution emulating the solvent composition of the aqueous ink composition as in the first embodiment. Description of the first embodiment will be continued below.

Examples of the resin particles include, but are not particularly limited to, homopolymers and copolymers of (meth)acrylic acid, (meth)acrylate, acrylonitrile, cyanoacrylate, acrylamide, olefin, styrene, vinyl acetate, vinyl chloride, vinyl alcohol, vinyl ether, vinylpyrrolidone, vinylpyridine, vinylcarbazole, vinylimidazole, and vinylidene chloride, fluorine resins, and natural resins. Among these, (meth)acrylic resins that are homopolymers or copolymers of (meth)acrylic monomers such as (meth)acrylic acid, (meth)acrylate, acrylonitrile, cyanoacrylate, and acrylamide are preferable. Among the (meth)acrylic resins, a (meth) acrylic-vinyl copolymer resin that is a copolymer of a (meth)acrylic monomer and a vinyl monomer is preferable. To be noted, the copolymer described above may be in any form of a random copolymer, a block copolymer, an alternating copolymer, and a graft copolymer. Ejection stability and abrasion resistance tend to improve more when such resin particles are used. To be noted, the constituent ratio of the vinyl monomer in the (meth)acrylic-vinyl copolymer resin is preferably 20 to 65% by mass, more preferably 25 to 60% by mass, and further preferably 25 to 55% by mass. The anti-clogging property tends to improve more when the constituent ratio of the vinyl monomer is 20% by mass or more. In addition, the abrasion resistance tends to improve more when the constituent ratio of the vinyl monomer is 60% by mass or less. As the vinyl monomer, aromatic vinyl monomers such as styrene are preferable because the aromatic vinyl monomers are excellent in the anti-clogging property and the like.

In addition, a monomer having two or more polymerizable functional groups may be used. As a result, crosslinkability can be imparted to the resin, and the decrease rate of absorbance and other physical properties of the resin can be more easily adjusted. Examples of this include (meth) acrylic monomers and vinyl monomers having two or more functionalities.

The manner in which the resin particles described above are prepared is not particularly limited. For example, the resin particles can be obtained by a preparation method described below, and a plurality of methods may be combined as desired. Examples of the preparation method include a method of performing polymerization (emulsion polymerization) by mixing a polymerization catalyst (polymerization initiator) and a dispersant into a monomer of a component constituting a desired resin, a method of mixing a solution obtained by dissolving a resin having a hydrophilic part in a water-soluble organic solvent into water and then removing the water-soluble organic solvent by distillation or the like, and a method of mixing a solution obtained by dissolving a resin in a water-insoluble organic solvent into an aqueous solution together with a dispersant.

In the present embodiment, the resin particles may preferably include composite resin particles. The composite resin particles are resin particles constituted by two or more kinds of resins different from each other in the configuration (at least one of the kind and content ratio) of the monomer component constituting the resins. The two or more kinds of resins may constitute any part of the resin particles. For example, the two or more kinds of resins may have a three-dimensional mesh structure. Alternatively, two or more parts apart from one another may be formed from one kind of resin. The two or more kinds of resins are not limited to those whose configurations can be discontinuously distinguished at the boundary thereof, and the configuration of the monomer component thereof may change continuously.

Particularly, a case where one of the two or more kinds of resins serves as a core resin mainly constituting a center portion of the resin particles and another of the two or more kinds of resins serves as a shell resin mainly constituting a peripheral portion of the resin particles is preferable because the properties of resin can be varied between the peripheral portion and the center portion of the resin particles. In this case, it suffices as long as the shell resin constitutes at least part of the peripheral portion of the resin particles. Although a core-shell resin will be described as an example of the composite resin, the composite resin is not limited to the core-shell resin, and can achieve a similar effect in other forms. Core-shell resin is preferable because the degree of crosslinking and the glass transition temperature can be controlled independently for the core and the shell in the core-shell resin, and thus the solubility of the resin of the resin particles can be easily adjusted. Therefore, when a core-shell resin is used, the decrease rate of absorbance of light having a wavelength of 400 nm in 1 hour at 40° C. and the decrease rate of absorbance of light having a wavelength of 400 nm in 1 hour at 80° C. tend to be easy to control within the respective preferable ranges.

In addition, dissolution time can be also adjusted when using a resin different from a core-shell resin, by the glass transition temperature and the degree of crosslinking of the resin. Further, the dissolution time can be adjusted not only by the glass transition temperature and the degree of crosslinking but also by the composition such as the kind and amount of the monomer used for synthesizing the resin.

In addition, the resin particles may be formed from a straight-chain polymer, a branched polymer, or a three-dimensionally crosslinked polymer, and the three-dimensionally crosslinked polymer is preferable among these.

The average particle diameter of the resin particles is preferably 150 to 300 nm, more preferably 155 to 290 nm, and further preferably 160 to 280 nm. The ejection stability and the abrasion resistance tend to improve more when the average particle diameter of the resin particles is within the range described above. The average particle diameter of the resin particles can be measured by using light scattering.

The glass transition temperature of the resin constituting the resin particles is preferably 60 to 100° C., and more preferably 150 to 300° C. The glass transition temperature can be measured by differential scanning calorimetry (DSC).

The lower limit of the content of the resin particles is preferably 1% by mass or more, more preferably 2% by mass or more, and further preferably 3% by mass or more, with respect to 100% by mass of the aqueous ink composition. In addition, the upper limit of the content of the resin particles is preferably 10% by mass or less, more preferably 7.5% by mass or less, and further preferably 5% by mass or less, with respect to 100% by mass of the aqueous ink composition. The abrasion resistance and ejection stability of the recorded product tend to improve more when the content of the resin particles is within the range described above.

Solvent

Examples of the solvent include, but are not particularly limited to, one or more kinds selected from the group consisting of polyols, alkanediols, glycol ethers, and nitrogen-containing solvents. One kind of solvent may be used alone or two or more kinds of solvent may be used together.

Examples of the polyols include, but are not particularly limited to, those including three or more hydroxyl groups for one alkane and those in which a plurality of alkanediols are bonded via ether bonding. The alkane serving as a constituent of the polyols described above preferably has 5 or less carbon atoms and more preferably has 4 or less carbon atoms. Examples of the polyols further include diols of alkanes having 4 or less carbon atoms. More specifically, the examples include glycerol, ethylene glycol, diethylene glycol, triethyleneglycol, polyethylene glycol, dipropylene glycol, tripropylene glycol, 1,3(or 1,2)-propanediol, and polypropylene glycol.

Examples of the alkanediols include diols of alkanes having 5 or more carbon atoms. Examples of the diols include, but are not particularly limited to, 1,2-pentanediol, 1,2-hexanediol, 1,4-butanediol, 1,5-pentanediol, 1,6-hexanediol, 1,7-heptanediol, and 1,8-octanediol. Diols of alkanes having 10 or less carbon atoms are preferable.

Examples of the glycol ethers include, but are not particularly limited to, alkylene glycol monoethers such as ethylene glycol monomethyl ether, ethylene glycol monoethyl ether, ethylene glycol monopropyl ether, ethylene glycol monobutyl ether, ethylene glycol monomethyl ether acetate, diethylene glycol monomethyl ether, diethylene glycol monoethyl ether, diethylene glycol monopropyl ether, diethylene glycol monobutyl ether, diethylene glycol mono-t-butyl ether, triethylene glycol monobutyl ether, 1-methyl-1-methoxybutanol, propylene glycol monomethyl ether, propylene glycol monoethyl ether, propylene glycol monopropyl ether, propylene glycol monobutyl ether, dipropylene glycol monomethyl ether, dipropylene glycol monoethyl ether, di propylene glycol monopropyl ether, and dipropylene glycol monobutyl ether; and alkylene glycol diethers of these. Examples of the glycol ethers include those in which one or two hydroxyl groups of alkylene glycols or a plurality of alkylene glycols bonded via ether bonding are etherified. The alkylene glycol serving as a constituent described above preferably has 2 to 5 carbon atoms. The ether serving as a constituent described above is preferably an alkyl ether having 1 to 4 carbon atoms.

Examples of the nitrogen-containing solvents include, but are not particularly limited to, pyrrolidone-based solvents, imidazolidinone-based solvents, amide-based solvents, pyridine-based solvents, pyrazine-based solvents, and pyridone-based solvents. Examples of the amide-based solvents include cyclic amides and acyclic amides. Examples of the cyclic amides include pyrrolidone-based solvents, and examples of the pyrrolidone-based solvents include 2-pyrrolidone, N-methyl-2-pyrrolidone, N-ethyl-2-pyrrolidone, N-vinyl-2-pyrrolidone, N-butyl-2-pyrrolidone, and 5-methyl-2-pyrrolidone. In addition, examples of the acyclic amides include N,N-dialkylalkaneamides. Examples of the N,N-dialkylalkaneamides include N,N-dialkylpropionamides. Examples of the N,N-dialkylpropionamides include 3-alkoxy-N,N-dialkylpropionamide. Examples of the 3-alkoxy-N,N-dialkylpropionamide include 3-methoxy-N,N-dimethylpropionamide and 3-butoxy-N,N-dimethylpropionamide.

In the present embodiment, in the aqueous ink composition, the content of an organic solvent of a polyol having a normal boiling point of 280° C. or higher is preferably 0.5% by mass or less. As a result, a hitting position deviation tends to be further suppressed, the image quality tends to be better, and the abrasion resistance tends to be better. Examples of such a solvent include, but are not particularly limited to, glycerol. The content is more preferably 0.1% by mass or less, and the lower limit thereof is 0% by mass or more. Further, in the present embodiment, the content of an organic solvent having a normal boiling point of 280° C. or higher being 0.5% by mass or less is further preferable regarding the point described above, and it is more preferable that the content is within the range described above.

The content of the solvent is preferably 10 to 40% by mass, more preferably 15 to 35% by mass, and further preferably 20 to 30% by mass, with respect to 100% by mass of the aqueous ink composition. The dispersion stability of pigment and the resin component in the ink, the continuous ejection stability, the embeddability (wet-spreadability) and permeability of the ink to the recording medium, the abrasion resistance, and the drying resistance of the ink tend to improve more when the content of the solvent is within the range described above.

In addition, among solvents, examples of resin-dissolving solvents include, but are not particularly limited to, polar aprotic solvents such as dimethyl sulfoxide (DMSO), dimethylformamide (DMF), hexamethylphosphoramide (HMPA), amide-based solvents, and dioxane. Among these, amide-based solvents are preferable. Among the amide-based solvents, cyclic amides are preferable from the viewpoint of the anti-clogging property. Among the cyclic amides, pyrrolidone-based solvents are more preferable. Among the pyrrolidone-based solvents, N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone are more preferable, and 2-pyrrolidone is further preferable. In addition, among the amide-based solvents, acyclic amides are preferable from the viewpoint of abrasion resistance. Among the acyclic amides, N,N-dialkylpropionamides such as 3-methoxy-N,N-dimethylpropionamide are particularly preferable.

The content of the resin-dissolving solvent is preferably 50 to 80% by mass, more preferably 55 to 77% by mass, and further preferably 60 to 70% by mass, when the total content of solvent is 100% by mass. With such a composition, the decrease rate of absorbance described above can be adjusted in a more preferable manner, and thus the effect of the invention can be more effectively obtained.

Water

The ink composition of the present embodiment is an aqueous ink composition. The content of water is preferably 50 to 90% by mass, more preferably 55 to 80% by mass, and further preferably 60 to 75% by mass, with respect to 100% by mass of the aqueous ink composition.

An aqueous ink is not absorbed in a low-absorbency or unabsorbent recording medium such as a resin film, and is repelled on the recording medium. Therefore, the aqueous ink inherently has a problem that a high-quality image having a high embeddability on an unabsorbent recording medium cannot be recorded with the aqueous ink as compared with an organic-solvent-based ink or the like. However, according to the present embodiment, an image with a higher quality can be recorded even in the case where the image is recorded on a low-absorbency or unabsorbent recording medium.

Surfactant

Examples of the surfactant include, but are not particularly limited to, acetylene glycol-based surfactants, fluorine-based surfactants, and silicone-based surfactants.

Preferable examples of the acetylene glycol-based surfactants include, but are not particularly limited to, one or more kinds selected from 2,4,7,9-tetramethyl-5-decyne-4,7-diol, alkylene oxide adducts of 2,4,7,9-tetramethyl-5-decyne-4,7-diol, 2,4-dimethyl-5-decyne-4-ol, and alkylene oxide adducts of 2,4-dimethyl-5-decyne-4-ol. Examples of commercially available products of fluorine-based surfactants include, but are not particularly limited to, OLFINE 104 series and E series such as OLFINE E1010 (product names of Air Products Japan, Inc.), and Surfynol 465 and Surfynol 61 (product names of Nissin Chemical Industry Co., Ltd.). One kind of acetylene glycol-based surfactant may be used alone, and two or more kinds of acetylene glycol-based surfactants may be used in combination.

Examples of the fluorine-based surfactants include, but are not particularly limited to, perfluoroalkylsulfonic acid salts, perfluoroalkylcarboxylic acid salts, perfluoroalkylphosphates, per fluoroalkylethylene oxide adducts, perfluoroalkylbetaines, and perfluoroalkylamine oxide compounds. Examples of commercially available products of fluorine-based surfactants include, but are not particularly limited to, S-144 and S-145 (manufactured by AGC Inc.); FC-170C, FC-430, and Fluorad-FC4430 (manufactured by Sumitomo 3M); FSO, FSO-100, FSN, FSN-100, and FS-300 (manufactured by Dupont); and FT-250 and 251 (manufactured by Neos corporation). One kind of fluorine-based surfactant may be used alone, and two or more kinds of fluorine-based surfactants may be used in combination.

Examples of the silicone-based surfactants include polysiloxane-based compounds, and polyether-modified organosiloxane. Specific examples of commercially available products of the silicone-based surfactants include, but are not particularly limited to, BYK-306, BYK-307, BYK-333, BYK-341, BYK-345, BYK-346, BYK-347, BYK-348, and BYK-349 (product names of BYK Japan KK), and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (product names of Shin-Etsu Chemical Co., Ltd.).

The content of the surfactant is preferably 0.3 to 3% by mass, more preferably 0.5 to 2.75% by mass, and further preferably 1 to 2.5% by mass, with respect to 100% by mass of the aqueous ink composition. The image quality of the resulting recorded product, the abrasion resistance, and the ejection stability tend to improve more when the content of the surfactant is within the range described above.

Pigment

The pigment is not particularly limited, and, for example, known pigments shown below can be used.

Examples of black pigment include, but are not particularly limited to, No. 2300, No. 900, MCF88, No. 33, No. 40, No. 45, No. 52, MA7, MA8, MA100, and No. 2200B (manufactured by Mitsubishi Chemical Corporation), Raven 5750, Raven 5250, Raven 5000, Raven 3500, Raven 1255, and Raven 700 (manufactured by Carbon Columbia), Regal 400R, Regal 330R, Regal 660R, Mogul L, Monarch 700, Monarch 800, Monarch 880, Monarch 900, Monarch 1000, Monarch 1100, Monarch 1300, and Monarch 1400 (manufactured by CABOT JAPAN K.K.), and Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, and Special Black 4 (manufactured by Degussa).

Examples of white pigments include, but are not particularly limited to, C.I. pigment white 6, 18, and 21, and inorganic white pigments of titanium oxide, zinc oxide, zinc sulfide, antimony oxide, magnesium oxide, and zirconium oxide. In addition to the inorganic white pigments, organic white pigments such as white hollow resin particles and white polymer particles can be used.

Examples of pigments used for yellow ink include, but are not particularly limited to, C.I. pigment yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of pigments used for magenta ink include, but are not particularly limited to, C.I. pigment red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, and 245, and C.I. pigment violet 19, 23, 32, 33, 36, 38, 43, and 50.

Examples of pigments used for cyan ink include, but are not particularly limited to, C.I. pigment blue 1, 2, 3, 15, 15:1, 15:2, 15:3, 15:34, 15:4, 16, 18, 22, 25, 60, 65, and 66, and C.I. pigment vat blue 4 and 60.

In addition, examples of pigments used for color inks other than magenta, cyan, and yellow include, but are not particularly limited to, C.I. pigment green 7 and 10, C.I. pigment brown 3, 5, 25, and 26, and C.I. pigment orange 1, 2, 5, 7, 13, 14, 15, 16, 24, 34, 36, 38, 40, 43, and 63.

Examples of pearl pigments include, but are not particularly limited to, pigments having pearl luster or interference luster such as titanium dioxide-coated mica, argentine, and bismuth oxychloride.

Examples of metallic pigments include, but are not particularly limited to, particles formed from simples or alloys of aluminum, silver, gold, platinum, nickel, chromium, tin, zinc, indium, titanium, and copper.

The content of the pigment is preferably 0.1 to 30% by mass, more preferably 0.2 to 20% by mass, and further preferably 0.2 to 5% by mass, with respect to 100% by mass of the aqueous ink composition.

Other Resins

The aqueous ink composition of the present embodiment may contain another resin such as a pigment dispersant. Examples of the pigment dispersant include, but are not particularly limited to, polyvinyl alcohols, polyvinylpyrrolidones, polyaclylic acid, aclylic acid-acrylonitrile copolymer, vinyl acetate-acrylate copolymer, acrylic acid-acrylate copolymer, styrene-acrylic acid copolymer, styrene-methacrylic acid copolymer, styrene-methacrylic acid-acrylate copolymer, styrene-α-methylstyrene-acrylic acid copolymer, styrene-α-methylstyrene-acrylic acid-acrylate copolymer, styrene-maleic acid copolymer, styrene-maleic anhydride copolymer, vinylnaphthalene-acrylic acid copolymer, vinylnaphthalene-maleic acid copolymer, vinyl acetate-maleate copolymer, vinyl acetate-crotonic acid copolymer, vinyl acetate-acrylic acid copolymer, and salts of these. Among these, styrene-acrylic acid copolymer is preferable. The copolymer may be used in any form among random copolymer, block copolymer, alternating copolymer, and graft copolymer.

Other Components

Various additives such as a dissolution auxiliary, a viscosity adjuster, a pH adjuster, an antioxidant, a preservative, an antifungal agent, a corrosion inhibitor, and a chelating agent for capturing metal ions that affect dispersion may be appropriately added to the aqueous ink composition used in the present embodiment to maintain good storage stability and good ejection stability from the head, address clogging, or preventing deterioration of the ink.

Drying Step

The ink jet recording method of the present embodiment may include a drying step (also referred to as a post-drying step) of drying the recording medium to which the aqueous ink composition is attached after the ink attaching step. As a result, the resin contained in the aqueous ink composition on the recording medium melts, and a recorded product having a good embeddability can be formed. The drying step may be the final step for completing the recorded product such that the recorded product is good for use. The surface temperature of the recording medium in the drying step is preferably 50 to 150° C., more preferably 70 to 120° C., and further preferably 80 to 100° C. The abrasion resistance tends to improve when the drying temperature is within the range described above.

Ink Jet Recording Apparatus

The ink jet recording apparatus of the present embodiment is not particularly limited as long as the ink jet recording apparatus performs recording by the ink jet recording method described above, includes a heater that heats a recording medium, and a nozzle through which an aqueous ink composition is ejected onto the recording medium. FIG. 1 is a schematic section view of the recording apparatus according to the present embodiment. As illustrated in FIG. 1, a recording apparatus 1 includes a recording head 2, an infrared (IR) heater 3, a platen heater 4, a drying heater 5, a cooling fan 6, a preheater 7, and a fan 8.

The recording head 2 ejects an ink composition toward a recording medium 10. A conventionally known system can be used for the recording head 2, and examples thereof include a head that ejects a droplet by using vibration of a piezoelectric element, that is, forms an ink droplet by mechanical deformation of an electrostrictive element. The IR heater 3 and the platen heater 4 mainly heat the recording medium, but can also heat the recording head. The IR heater 3 can heat the recording medium from the side on which the recording head 2 is located. In addition, the platen heater 4 can heat the recording medium from the side opposite to where the recording head 2 is located. The drying heater 5 dries the recording medium to which the ink composition is attached. As a result of heating the recording medium on which an image has been recorded, moisture and so forth contained in the ink composition evaporates and scatters more quickly, and a coating film is formed by polymer particles contained in the ink composition. In this manner, a dried product of the ink strongly fixes (adheres) onto the recording medium, and thus a high-quality image that is excellent in abrasion resistance can be obtained in a short time. During the recording, the recording medium 10 is transported from right to left in FIG. 1.

The recording apparatus 1 may include the cooling fan 6. When the ink composition on the recording medium is cooled by the cooling fan 6 after drying, there is a tendency that a coating film having good adhesion to the recording medium can be formed.

In addition, the recording apparatus 1 may include the preheater 7 that heats (preheats) the recording medium in advance before the ink composition is ejected onto the recording medium. When the recording medium is preheated before ejecting the ink composition, there is a tendency that a high-quality image having less blur can be formed on the recording medium, particularly an unabsorbent or low-absorbency recording medium.

The recording head 2 is mounted on a carriage 9. The carriage 9 performs scanning (main scanning) to eject the ink composition from the head while moving in a front-rear direction in FIG. 1 to attach the ink composition to the recording medium to which the head is opposed. Recording is performed by alternately performing the scanning and transport (sub scanning) of the recording medium 10. That is, a multi-pass recording method in which recording is performed by performing scanning a plurality of times is used.

Furthermore, the recording apparatus 1 may include the fan 8 for blowing air to/across the surface of the recording medium from the viewpoint of adjusting the relative temperature of the recording medium and the nozzle surface and the viewpoint of efficient drying of the ink composition.

Figure 2A:
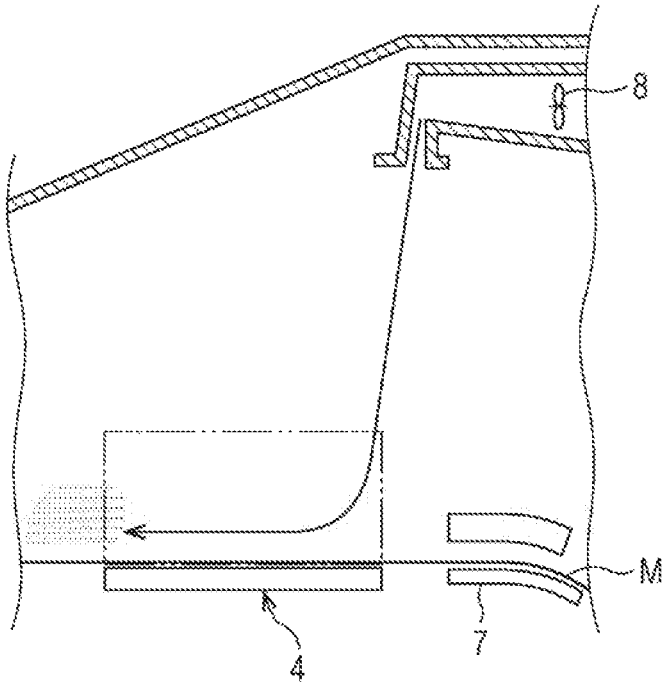
FIGS. 2A and 2B are partial side views of the recording apparatus in an ink attaching step, FIG. 2A illustrating an embodiment which is not provided with a carriage, FIG. 2B illustrating an embodiment which is provided with a carriage.
Figure 2B:
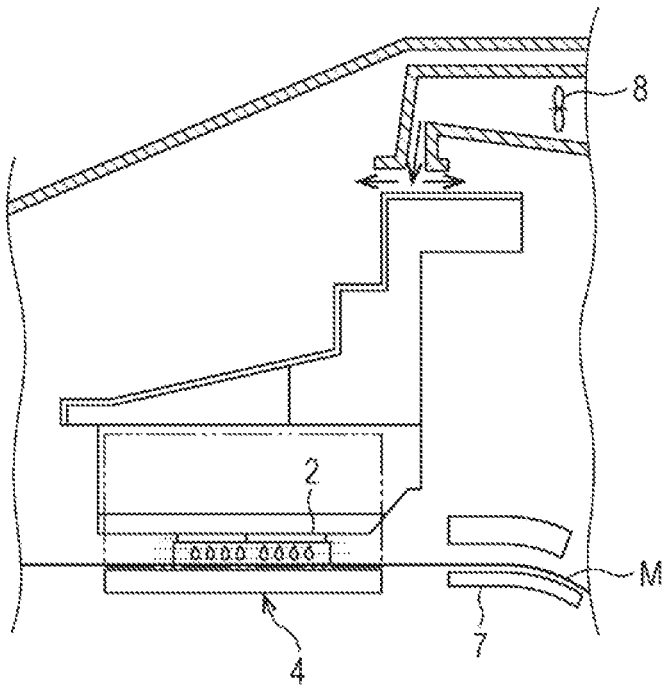

To describe the fan 8 more in detail, description will be given with reference to FIGS. 2A and 2B. Also in FIGS. 2A and 2B, the recording head 2 is mounted on a carriage, and main scanning is performed by ejecting the ink composition from the head while moving in the front-rear direction in FIGS. 2A and 2B serving as a main scanning direction. In FIGS. 2A and 2B, FIG. 2A illustrates a state in which air is blowing to the recording medium at a portion in the main scanning direction (front-rear direction in FIG. 2A) where the carriage is not present, and FIG. 2B illustrates a state in which air is not directly blowing to the recording medium at a portion where the carriage is present.

A plurality of fans 8 are arranged along the width direction (main scanning direction) of the recording medium 10, which is the front-rear direction in FIGS. 2A and 2B so as to be capable of blowing a belt-like air (a band of air) extending from one end to the other end of the recording medium 10 in the width direction the entire time.

In FIG. 2A, the air hits the surface of the recording medium 10. Since the hitting angle is inclined to the left in FIG. 2A with respect to the surface of the recording medium, the direction of the air changes to the left in FIG. 2A, and the air continues parallel to the recording medium to the downstream side in a recording medium transport direction in the region on the recording medium to which the ink is attached. As a result, drying of the ink in the region on the recording medium to which the ink is attached can be accelerated.

In contrast, in FIG. 2B, the air hits an air-shielding member provided on an upper portion of the carriage, splits and changes direction to the right and left in FIG. 2B, and thus does not directly hit the surface of the recording medium. As a result, the influence of clogging and hitting position deviation caused by the air hitting the nozzle and a dropping (an ejected) ink droplet can be reduced at the portion where the carriage is present.

However, the direction of the air blown parallel to the surface of the recording medium in FIG. 2A sometimes changes slightly, and sometimes the hitting position and the like is affected as a result of the air blowing from the side to the recording head 2 also at the portion where the carriage is present. In addition, the air that has hit the air-shielding member and whose direction has been changed sometimes blows in an undesired direction in FIG. 2B, and sometimes a similar influence slightly occurs.

To be noted, the fan 8 of FIGS. 2A and 2B is merely an embodiment of an air blowing unit that blows air onto the recording medium, and the air blowing unit is not limited to this as long as the air blowing unit is capable of blowing air to the recording medium. As other embodiments, an embodiment of making the air outlet horizontal and blowing air to the top layer of the recording medium and an embodiment of blowing air from above to the ink-attached region of the surface of the recording medium can be considered.

In addition, although the recording apparatus described above uses a multi-pass recording method, a single-pass recording method in which recording is performed in one scan by using a line head having a length equal to or longer than a recording width in the width direction of the recording medium may be performed. In this case, in the air blowing step, air may be blown in the direction of the line head from the upstream side or the downstream side in the transport direction of the recording medium. In addition, air may be blown against the recording medium or in a direction parallel to the surface of the recording medium on the side downstream of the head in the transport direction of the recording medium.

EXAMPLES

Advantages of the invention will be described in more detail below by using examples and comparative examples. The scope of the invention is limited by the examples below.

Material for Ink Composition

Main materials for the ink composition used in examples and comparative examples shown below are as follows.

Colorant

C.I. pigment blue 15:3

Pigment Dispersant styrene-acrylic acid-based water-soluble resin

Resin Particles

Resin particles 1 to 14 were prepared in accordance with production examples shown below.

Resin particle 15: polycarbonate-based urethane resin

Resin particle 16: polycarbonate-based urethane resin

Solvent 2-pyrrolidone 3-methoxy-N,N-dimethylpropionamide propylene glycol 1,3-butanediol 1,2-hexanediol Surfactant BYK-348 (product name of BYK Japan KK)

Production Example of Resin Particle 1

A reaction vessel was equipped with a dripping apparatus, a thermometer, a water-cooled circulation condenser, and a stirrer, 100 parts of ion-exchange water was charged in the reaction vessel, 0.2 parts of potassium persulfate serving as a polymerization initiator was added to the system at 70° C. in a nitrogen atmosphere while stirring the ion-exchange water, and a monomer solution consisting of 7 parts of ion-exchange water, 0.05 parts of sodium lauryl sulfate, 114 parts of styrene, 45 parts of n-butyl acrylate, and 0.02 parts of t-dodecyl mercaptan was dripped to the system at 70° C. to cause reaction to prepare dispersed matter formed from first resin. Then, 2 parts of 10% solution of ammonium persulfate was added to the system, the system was stirred, further a reaction liquid consisting of 30 parts of ion-exchange water, 0.2 parts of potassium lauryl sulfate, 22 parts of methyl acrylate, 17 parts of ethyl acrylate, 26 parts of methyl methacrylate, 4 parts of acrylic acid, and 0.5 parts of t-dodecyl mercaptan was added to the system at 70° C. while stirring the system to cause polymerization reaction, then polymerization of second resin is caused by neutralizing the system to pH of 8 to 8.5 with sodium hydroxide and filtrating the system with a 0.3 μm filter, and thus a water dispersion of composite resin fine particles formed from the first resin and the second resin was prepared. Specifically, the water dispersion was a water dispersion of core-shell resin fine particles. To be noted, the amount of added monomers described above served as the standard, and the amounts and kinds of (meth)acrylic monomers were adjusted and changed such that overall Tg of the resin was 80° C. The constituent ratio of vinyl monomer (styrene) was 51% by mass.

Differential scanning calorimetry (DSC) was performed on the resin particles obtained as described above in accordance with JIS K7121 to obtain the overall glass transition temperature Tg (° C.) of the resin particles, and the obtained Tg was 80° C. A differential scanning calorimeter "DSC6220" manufactured by Seiko Instruments Inc. was used. To be noted, measurement of the glass transition temperature Tg was the same in production examples below.

In addition, the composite resin fine particles obtained as described above were subjected to measurement by microtrac UPA (NIKKISO CO., LTD.) to obtain a particle diameter φ (nm) (based on volume) of the core-shell polymer particles, and the obtained average particle diameter was 225 nm. To be noted, measurement of the average particle diameter was the same in the production of the examples below.

Production Example of Resin Particles 2 to 14

Resin Particles 2 to 14 were prepared in a similar manner to the production example of Resin Particle 1 except that the monomer composition (kind and mass ratio of monomer) and conditions (amount of polymerization initiator, temperature, time, stirring speed, and concentration) for polymerization were changed. To be noted, commercially available aqueous dispersants of urethane resin were used as Resin Particles 15 and 16.

The resin particles produced as described above are summarized in Table 1 below.

TABLE 1

| Resin Particle No. | Constituent ratio of vinyl monomer (% by mass) | Tg (° C.) | Chemical species | Average particle diameter (nm) |
|---|---|---|---|---|
| Resin Particle 1 | 51 | 80 | St-Ac | 225 |
| Resin Particle 2 | 26 | 80 | St-Ac | 221 |
| Resin Particle 3 | 52 | 80 | St-Ac | 169 |
| Resin Particle 4 | 48 | 80 | St-Ac | 275 |
| Resin Particle 5 | 47 | 95 | St-Ac | 214 |
| Resin Particle 6 | 48 | 67 | St-Ac | 209 |
| Resin Particle 7 | 24 | 80 | St-Ac | 182 |
| Resin Particle 8 | 21 | 80 | St-Ac | 218 |
| Resin Particle 9 | 68 | 80 | St-Ac | 208 |
| Resin Particle 10 | 68 | 80 | St-Ac | 214 |
| Resin Particle 11 | 68 | 80 | St-Ac | 154 |
| Resin Particle 12 | 5 | 80 | St-Ac | 119 |
| Resin Particle 13 | 5 | 80 | St-Ac | 189 |
| Resin Particle 14 | 74 | 80 | St-Ac | 167 |
| Resin Particle 15 | — | 120 | Carbonate-based PU | 60 |
| Resin Particle 16 | — | 90 | Carbonate-based PU | 60 |

Preparation of Aqueous Ink Composition

A pigment dispersion in which a pigment is dispersed in a pigment dispersant was prepared. This and other materials were mixed in Basic Compositions 1 to 3 shown in Table 2 below and stirred sufficiently, and thus respective aqueous ink compositions (Inks 1 to 22) were obtained. Combinations of Compositions 1 to 3 and resin particles for constituting Inks 1 to 22 will be shown in Table 3 that will be shown later. In Table 2 below, the unit of numerical values is % by mass, and the sum thereof is 100.0% by mass.

TABLE 2

| | | Composition 1 | Composition 2 | Composition 3 |
|---|---|---|---|---|
| Pigment (solid component) | C.I. pigment blue 15:3 | 2 | 2 | 2 |
| Pigment dispersant | Styrene-acrylic acid-based resin dispersant | 1 | 1 | 1 |
| Resin emulsion | See Table 3 | 4 | 4 | 4 |
| Solvent | 2-pyrrolidone | 14 | 15 | 7 |
| | 3-methoxy-N,N-dimethylpropionamide | | | 7 |
| | Propylene glycol | 6 | | 6 |
| | 1,3-butanediol | | 6 | |
| | 1,2-hexanediol | | 6 | |
| Surfactant | BYK-348 | 2 | 2 | 2 |
| Water | | Rest | Rest | Rest |
| | Total | 100 | 100 | 100 |

Measurement of Decrease Rate of Absorbance of Light Having Wavelength of 400 nm

First, 100 g of liquid mixtures containing resin particles such that the resin solid component was 0.5% by mass with respect to the liquid mixtures were separately prepared by using the combinations of the resin particles and the solvent compositions respectively used for Inks 1 to shown in Table 3. Each obtained liquid mixture was charged and sealed in a glass container and left to stand for 1 hour at 25° C., and then the absorbance Abs25 after the stand was measured. Further, in a similar manner, the absorbance Abs40 after leaving the liquid mixture to stand for 1 hour at 40° C. and the absorbance Abs80 after leaving the liquid mixture to stand for 1 hour at 80° C. were measured. To be noted, the liquid mixture after the stand was once returned to the state of 25° C. before measurement, and was subjected to measurement after vertically shaking the glass container 10 times and leaving the glass container to stand for 1 minute.

The absorbance of light having a wavelength of 400 nm was measured by using an absorbance meter (U-3900H manufactured by Hitachi High-Tech Science Corporation, measurement mode: wavelength scan, scan speed: 600 nm/min). The decrease rate (%) of absorbance in 1 hour stand at 40° C. and the decrease rate (%) of absorbance in 1 hour stand at 80° C. were calculated in accordance with the formulae described above. The results are shown in Table 3.

TABLE 3

| | | | | Absorbance | | | Decrease rate of absorbance (%) | |
|---|---|---|---|---|---|---|---|---|
| | | | Solvent composition for measurement of absorbance | 20° C. 1 h | 40° C. 1 h | 80° C. 1 h | 40° C. 1 h | 80° C. 1 h |
| Ink 1 | Resin Particle 1 | Composition 1 | 2-pyrrolidone: 70% | 2.94 | 2.81 | 2.56 | 4.3 | 12.8 |
| Ink 2 | Resin Particle 2 | Composition 1 | Propylene glycol: 30% | 1.64 | 1.48 | 0.69 | 9.8 | 57.9 |
| Ink 3 | Resin Particle 3 | Composition 1 | | 2.54 | 2.31 | 2.11 | 9.1 | 16.9 |
| Ink 4 | Resin Particle 4 | Composition 1 | | 3.01 | 2.95 | 2.76 | 2.0 | 8.3 |
| Ink 5 | Resin Particle 5 | Composition 1 | | 3.12 | 3.01 | 2.77 | 3.5 | 11.2 |
| Ink 6 | Resin Particle 6 | Composition 1 | | 1.73 | 1.57 | 1.45 | 9.2 | 16.2 |
| Ink 7 | Resin Particle 7 | Composition 1 | | 1.29 | 0.93 | 0.51 | 27.8 | 60.4 |
| Ink 8 | Resin Particle 8 | Composition 1 | | 1.58 | 1.00 | 0.37 | 36.5 | 76.4 |
| Ink 9 | Resin Particle 9 | Composition 1 | | 3.40 | 3.38 | 3.33 | 0.7 | 2.0 |
| Ink 10 | Resin Particle 10 | Composition 1 | | 3.03 | 3.02 | 3.00 | 0.3 | 1.0 |
| Ink 11 | Resin Particle 11 | Composition 1 | | 3.29 | 3.25 | 3.21 | 1.2 | 2.5 |
| Ink 12 | Resin Particle 12 | Composition 1 | | 0.15 | 0.04 | 0.05 | 74.7 | 64.0 |
| Ink 13 | Resin Particle 13 | Composition 1 | | 0.41 | 0.11 | 0.07 | 72.5 | 83.0 |
| Ink 14 | Resin Particle 14 | Composition 1 | | 3.42 | 3.36 | 3.33 | 1.7 | 2.5 |
| Ink 15 | Resin Particle 15 | Composition 1 | | 0.00 | 0.00 | 0.00 | 0.0 | 0.0 |
| Ink 16 | Resin Particle 16 | Composition 1 | | 0.01 | 0.01 | 0.01 | 0.0 | 0.0 |
| Ink 17 | Resin Particle 1 | Composition 2 | 2-pyrrolidone: 55.6% | 3.01 | 2.91 | 2.67 | 3.3 | 11.3 |
| Ink 18 | Resin Particle 7 | Composition 2 | 1,3-butanediol: 22.2% | 1.34 | 1.01 | 0.60 | 24.6 | 55.2 |
| Ink 19 | Resin Particle 9 | Composition 2 | 1,2-hexanediol: 22.2% | 3.60 | 3.58 | 3.56 | 0.6 | 1.1 |
| Ink 20 | Resin Particle 1 | Composition 3 | 2-pyrrolidone: 35% | 2.64 | 2.41 | 2.19 | 8.7 | 17.0 |
| Ink 21 | Resin Particle 7 | Composition 3 | 3-methoxy-N,N- | 1.02 | 0.65 | 0.29 | 36.3 | 71.6 |
| Ink 22 | Resin Particle 9 | Composition 3 | dimethylpropionamide: 35% Propylene glycol: 30% | 3.31 | 3.26 | 3.21 | 1.5 | 3.0 |

Ink Jet Recording Apparatus

SC-S80650 (manufactured by Seiko Epson Corporation) which was modified (hereinafter referred to as "modified apparatus of SC-S80650") by, for example, providing a fan to blow air to a platen region and into which the aqueous ink composition prepared as described above was injected was used. To be noted, where the fan was disposed was as illustrated in FIGS. 2A and 2B.

Ink Jet Recording Method

A polyvinyl chloride sheet ("IJ-40" manufactured by Sumitomo 3M) was used as the recording medium. The recording medium was heated to temperatures shown in Tables 4 and 5 in a state in which a platen heater and a fan was operated. In addition, the recording medium was set such that the distance between the nozzle and the recording medium was a distance shown in Table 4 or 5 in the ink attaching step. The recording medium was supplied to the recording apparatus in this state, and the injected aqueous ink composition was ejected and attached to the heated recording medium. At this time, the temperature of the nozzle was a value shown in Table 4 or 5. To be noted, the amount of attached ink was adjusted to 13 mg/inch$^2$, and a recording pattern of 5 cm×5 cm was recorded. The recording resolution of the recording pattern was set to 1440×1440 dpi. The air speed of air supplied by the fan was as shown in Tables 4 and 5, and the air temperature was set to a normal temperature of 25° C. To be noted, in Comparative Examples 17 and 18, the recording method described above was executed in a state in which the platen heater was not operated. In Example 10 and Comparative Examples 16 and 19, the recording method described above was executed in a state in which the air temperature was adjusted to a temperature of hot air (about 40 to 45° C.) such that the surface temperature of the nozzle was a value shown in Table 4 or 5. After the ink attaching step, the recording medium was heated by a drying heater disposed downstream of the platen heater for about 1 minute at 80° C. to obtain a recorded product.

Temperature Measurement Method

The temperature of the nozzle was measured by providing a temperature sensor on a nozzle surface in which the nozzle of the head was formed. At this time, the highest temperature during attachment of the ink in the recording was used as the temperature of the nozzle. In addition, the average of the surface temperature of the recording medium at a position that can face the head on the platen during the recording was used as the temperature of the recording medium.

Measurement Method of Air Speed and Air Temperature

The air blown by the fan was supplied onto the recording medium in a state illustrated in FIG. 2A in which there was no air-shielding object such as a carriage therebetween, and the speed of air blowing parallel to the surface of the recording medium in the state of FIG. 2A without the carriage was measured as the air speed thereof. In addition, the air temperature was measured at a position near the air outlet of FIG. 2A so as not to be affected by the surface temperature of the recording medium or the like.

TABLE 4

| | Examples | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Ink | Ink 1 | Ink 2 | Ink 3 | Ink 5 | Ink 6 | Ink 17 | Ink 20 | Ink 1 | Ink 1 | Ink 1 | Ink 1 | Ink 1 | Ink 1 | Ink 1 |
| Nozzle surface temperature (° C.) | 35 | 35 | 35 | 35 | 35 | 35 | 35 | 34 | 37 | 42 | 42 | 31 | 38 | 35 |
| Recording medium surface temperature (° C.) | 38 | 38 | 38 | 38 | 38 | 38 | 38 | 38 | 38 | 38 | 46 | 35 | 38 | 38 |
| Temperature difference (° C.) | −3 | −3 | −3 | −3 | −3 | −3 | −3 | −4 | −1 | 4 | −4 | −4 | 0 | −3 |
| Nozzle-Recording medium distance (mm) | 1.7 | 1.7 | 1.7 | 1.7 | 1.7 | 1.7 | 1.7 | 2 | 1.4 | 2.3 | 1.7 | 1.7 | 0.7 | 2.8 |
| Air speed (m/s) | 2 | 2 | 2 | 2 | 2 | 2 | 2 | 4 | 0.5 | 2 | 2 | 2 | 0 | 0 |
| Abrasion resistance | B | A | B | B | B | B | A | B | B | B | B | B | B | B |
| Anti-clogging property | B | C | C | A | C | B | C | A | B | C | C | A | C | A |
| Image quality | B | B | B | B | B | B | B | B | B | A | A | C | C | C |
| Hitting position deviation | B | B | B | B | B | A | B | C | A | C | B | B | A | C |
| OD value | B | A | B | B | B | B | A | B | B | B | B | B | B | B |

TABLE 5

| | Comparative Examples | | | | | | | | | | |
|---|---|---|---|---|---|---|---|---|---|---|---|
| | 1 | 2 | 3 | 4 | 5 | 6 | 7 | 8 | 9 | 10 | 11 |
| Ink | Ink 7 | Ink 8 | Ink 9 | Ink 10 | Ink 11 | Ink 12 | Ink 13 | Ink 14 | Ink 15 | Ink 16 | Ink 18 |
| Nozzle surface temperature (° C.) | 35 | 35 | 35 | 35 | 35 | 35 | 35 | 35 | 35 | 35 | 35 |
| Recording medium surface temperature (° C.) | 38 | 38 | 38 | 38 | 38 | 38 | 38 | 38 | 38 | 38 | 38 |
| Temperature difference (° C.) | −3 | −3 | −3 | −3 | −3 | −3 | −3 | −3 | −3 | −3 | −3 |
| Nozzle-Recording medium distance (mm) | 1.7 | 1.7 | 1.7 | 1.7 | 1.7 | 1.7 | 1.7 | 1.7 | 1.7 | 1.7 | 1.7 |
| Air speed (m/s) | 2 | 2 | 2 | 2 | 2 | 2 | 2 | 2 | 2 | 2 | 2 |
| Abrasion resistance | A | A | C | C | C | A | A | C | A | A | A |
| Anti-clogging property | D | D | A | A | A | D | D | A | D | D | D |
| Image quality | B | B | B | B | B | B | B | B | B | B | B |

TABLE 5-continued

| | | | | | | | | | | | |
|---|---|---|---|---|---|---|---|---|---|---|---|
| Hitting position deviation | B | B | B | B | B | B | B | B | B | B | A |
| OD value | A | A | C | C | C | A | A | C | A | A | A |

| | Comparative Examples | | | | | | | | |
|---|---|---|---|---|---|---|---|---|---|
| | 12 | 13 | 14 | 15 | 16 | 17 | 18 | 19 | 20 |
| Ink | Ink 19 | Ink 21 | Ink 22 | Ink 1 | Ink 1 | Ink 1 | Ink 7 | Ink 9 | Ink 4 |
| Nozzle surface temperature (° C.) | 35 | 35 | 35 | 33 | 45 | 25 | 25 | 45 | 35 |
| Recording medium surface temperature (° C.) | 38 | 38 | 38 | 38 | 35 | 25 | 25 | 35 | 38 |
| Temperature difference (° C.) | −3 | −3 | −3 | −5 | 10 | 0 | 0 | 10 | −3 |
| Nozzle-Recording medium distance (mm) | 1.7 | 1.7 | 1.7 | 2.6 | 2.6 | 1.7 | 1.7 | 2.6 | 1.7 |
| Air speed (m/s) | 2 | 2 | 2 | 6 | 5 | 0 | 0 | 5 | 2 |
| Abrasion resistance | C | A | C | B | B | B | A | C | C |
| Anti-clogging property | A | D | C | A | D | A | B | D | A |
| Image quality | B | B | B | B | C | D | D | C | B |
| Hitting position deviation | A | B | B | D | C | B | B | C | B |
| OD value | C | A | B | B | B | B | A | C | B |

Image Quality

The recording pattern of the recorded product obtained by the recording method described above was visually observed, and the image quality was evaluated in accordance with the following evaluation criteria.

A: no unevenness in the pattern was observed, and no blur of ink was observed at the edge of the pattern B: no unevenness in the pattern was observed, but slight blur of ink was observed at the edge of the pattern C: slight unevenness was observed in the pattern D: unevenness in the pattern was obvious OD Value The optical density (OD value) of the recording pattern of the recorded product obtained by the recording method described above was measured by an OD meter (Spectrolino, product name of Gretag Macbeth), and evaluated in accordance with the following evaluation criteria.

A: the OD value was 1.8 or more

B: the OD value was 1.4 or more and less than 1.8

C: the OD value was less than 1.4

Anti-Clogging Property

In the recording method described above, a half of nozzles in an ink nozzle row were not allowed to eject the ink during recording, and recording was performed continuously for 2 hours. Then, suction cleaning was performed once, and the ejection state of the unused nozzles was inspected. The ratio of number of nozzles incapable of ejection after cleaning to the number of nozzles which had not performed ejection was calculated, and was evaluated in accordance with the following evaluation criteria.

A: the ratio of number of nozzles incapable of ejection was 1% or lower

B: the ratio of number of nozzles incapable of ejection was higher than 1% and equal to or lower than 3%

C: the ratio of number of nozzles incapable of ejection was higher than 3% and equal to or lower than 6%

D: the ratio of number of nozzles incapable of ejection was higher than 6%

Abrasion Resistance

The recording pattern part of the recorded product obtained by the recording method above was rubbed by an abrader formed by attaching a white cotton cloth (in accordance with JIS L 0803) to a Gakushin-Type fastness rubbing tester AB-301 (product name of a TESTER SANGYO CO., LTD.) by 50 cycles of reciprocation with a load of 270 g. Then, peeling of the recording pattern part of the recording medium was visually observed, and was evaluated in accordance with the following evaluation criteria.

A: no scratch or peeling of the recording pattern was observed, and no migration of ink to the white cotton cloth was observed B: no obvious scratch or peeling of the recording pattern was observed, but migration of ink to the white cotton cloth was observed C: obvious scratches and peeling of the recording pattern were observed Hitting Position Deviation The nozzles were caused to record a nozzle check pattern, and the deviation of hitting position from a normal hitting position of the ink droplet was measured for each nozzle. The average value of the nozzles was calculated and evaluated in accordance with the following evaluation criteria.

A: the position deviation was 20 or smaller when the distance between two adjacent nozzles was 100

B: the position deviation was larger than 20 and equal to or smaller than 40 when the distance between two adjacent nozzles was 100

C: the position deviation was larger than 40 and equal to or smaller than 60 when the distance between two adjacent nozzles was 100

D: the position deviation was larger than 60 when the distance between two adjacent nozzles was 100

As a result of the evaluation, all Examples in which the temperature difference between the temperature of the nozzle and the surface temperature of the recording medium in the ink attaching step after the heating step was −4 to 8° C. and the resin particles contained in the aqueous ink composition were formed from a resin whose decrease rate of absorbance of the resin of the resin particles in 1 hour at 40° C. was 15% or lower and the decrease rate of absorbance of the resin in 1 hour at 80° C. was 10% or higher in a liquid mixture containing the resin particles in the composition of solvent contained in the aqueous ink composition were superior in all aspects of abrasion resistance, anti-clogging property, image quality, and hitting position deviation.

In contrast, Comparative Examples different from these were inferior in at least one of the abrasion resistance (C), the anti-clogging property, the image quality (D), and the hitting position deviation (D).

More specifically, comparing Examples 1 to 5 with one another, there was a tendency that the anti-clogging property was better when the decrease rate of absorbance in 1 hour at 40° C. was lower and that the abrasion resistance was better when the decrease rate of absorbance in 1 hour at 80° C. was higher.

Comparison Examples 1, 8, 9, and 13, control of reducing the influence of heat from the recording medium on the nozzle by increasing the air speed or elongating the nozzle-recording medium distance could be minimized and the hitting position deviation was smaller when the temperature difference between the recording medium and the nozzle was larger. In contrast, the anti-clogging property was better when the temperature difference between the recording medium and the nozzle was smaller. In addition, the image quality was better when the nozzle temperature was reduced by blowing air.

Comparing Examples 1 and 10, the image quality was better when hot air was blown. In contrast, the anti-clogging property was better when air of a normal temperature was blown.

Comparing Examples 1, 11, and 12, the anti-clogging property was better when the surface temperature of the recording medium was lower, and the image quality was better when the surface temperature of the recording medium was higher.

Comparing Examples 1, 13, and 14, the drying of the ink was accelerated and the image quality was better when air blowing was used. In addition, the anti-clogging property was better when the nozzle-recording medium distance was larger, and the hitting position deviation was smaller when the nozzle-recording medium distance was smaller.

From Comparative Examples 1, 2, 6, 7, 11, and 13, it can be assumed that, in the case where the decrease rate of absorbance of light having a wavelength of 400 nm of the resin in 1 hour at 40° C. was higher than 15%, dissolution of the resin progressed inside the head in the ink attaching step and thus the anti-clogging property was poorer.

From Comparative Examples 3 to 5, 8, 12, 14, and 20, it can be assumed that, in the case where the decrease rate of absorbance of light having a wavelength of 400 nm of the resin in 1 hour at 80° C. was lower than 10%, the resin was not sufficiently dissolved to form a film in the post-drying step and thus the abrasion resistance was poorer.

The decrease rates of absorbance at 40° C. and 80° C. were approximately 0% in Comparative Examples 9 and 10 because the resin particles were already dissolved in the state of 25° C., and it can be assumed that the anti-clogging property is poor in such a state.

From Comparative Example 15, it can be assumed that the air speed needs to be increased or the nozzle-recording medium distance needs to be elongated in the case where the temperature difference between the nozzle and the recording medium was lower than −4%, and thus the hitting position deviation was larger.

From Comparative Examples 16 and 19, it can be assumed that dissolution of the resin in the head is more likely to progress in the case where the temperature difference between the nozzle and the recording medium is higher than 8° C., and thus the anti-clogging property was poorer.

From Comparative Examples 17 and 18, it can be seen that the image quality becomes lower in the case where the heating step is not used. To be noted, Comparative Example in which Ink 7 was used was relatively better than Comparative Example 1 in the anti-clogging property. From this result, it was found that the ink used in the present embodiment is needed for obtaining a good image quality by performing the heating step.

Further, comparing Examples 1, 6, and 7 and Comparative Examples 1 and 11 to 14, all of Examples in which Inks 1, 17, and 20 containing resin particles formed from a resin whose decrease rate of absorbance of light having a wavelength of 400 nm in 1 hour at 40° C. was 15% or lower and the decrease rate of absorbance of light having a wavelength of 400 nm in 1 hour at 80° C. was 10% or higher in a liquid mixture containing the resin particles in a solvent composition containing 2-pyrrolidone and propylene glycol in a mass ratio of 7:3 such that the resin solid component was 0.5% by mass and having the respective ink compositions were used were superior in all aspects of abrasion resistance, anti-clogging property, image quality, and hitting position deviation.

The entire disclosure of Japanese Patent Application No. 2017-210026 filed Oct. 31, 2017 is expressly incorporated herein by reference.

What is claimed is:

1. An ink jet recording method comprising:

heating a recording medium; and attaching an aqueous ink composition to the heated recording medium by ejecting the aqueous ink composition through a nozzle, the aqueous ink composition containing water, a solvent, and resin particles, wherein, in the attaching, a temperature difference between a temperature of the nozzle and a surface temperature of the heated recording medium is −4 to 8° C., and wherein the resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture containing the solvent contained in the aqueous ink composition and the particular resin particles, and a resin solid component of the liquid mixture is 0.5% by mass.

2. The ink jet recording method according to claim 1, wherein the temperature difference between the temperature of the nozzle and the surface temperature of the heated recording medium is −4 to −1° C.

3. The ink jet recording method according to claim 1, wherein the solvent contains one or more solvents selected from the group consisting of polyols, alkanediols, glycol ethers, nitrogen-containing solvents, and combinations thereof.

4. The ink jet recording method according to claim 1, wherein the resin particles include resin particles formed from a (meth)acrylic resin.

5. The ink jet recording method according to claim 4, wherein the resin particles contain a (meth)acrylic-vinyl copolymer resin, and a constituent ratio of vinyl monomer in the (meth)acrylic-vinyl copolymer resin is 20 to 65% by mass.

6. The ink jet recording method according to claim 1, wherein an average particle diameter of the resin particles is 150 to 300 nm.

7. The ink jet recording method according to claim 1, wherein a glass transition temperature of the resin constituting the particular resin particles is 60 to 100° C.

8. The ink jet recording method according to claim 1, wherein a distance between a nozzle surface of the nozzle and a surface of the heated recording medium is 0.5 to 3 mm.

9. The ink jet recording method according to claim 1, wherein the surface temperature of the heated recording medium in the attaching is 30° C. or higher.

10. The ink jet recording method according to claim 1, wherein the attaching includes blowing air to a region of the recording medium to which the aqueous ink composition is attached.

11. The ink jet recording method according to claim 10, wherein an air speed of the air at a surface of the recording medium is 0.5 m/sec or higher.

12. The ink jet recording method according to claim 10, wherein a temperature of the air is 30° C. or lower.

13. The ink jet recording method according to claim 1, wherein, in the aqueous ink composition, a content of a resin-dissolving solvent is 50 to 80% by mass with respect to a total content of organic solvent.

14. The ink jet recording method according to claim 1, wherein the aqueous ink composition contains 0.5% by mass or less of an organic solvent that is a polyol having a normal boiling point of 280° C. or higher.

15. An ink jet recording apparatus comprising:

a heater configured to heat a recording medium;

a nozzle configured to eject an aqueous ink composition to the heated recording medium, the aqueous ink composition containing water, a solvent, and resin particles; and means for providing a temperature difference between a temperature of the nozzle and a surface temperature of the heated recording medium to be −4 to 8° C., wherein the resin particles include particular resin particles formed from a resin whose decrease rate of absorbance of light having a wavelength of 400 nm is 15% or smaller in 1 hour at 40° C. and 10% or larger in 1 hour at 80° C. in a liquid mixture containing the solvent contained in the aqueous ink composition and the particular resin particles, and a resin solid component of the liquid mixture is 0.5% by mass.

16. The ink jet recording apparatus according to claim 15 wherein the temperature difference between the temperature of the nozzle and the surface temperature of the heated recording medium is −4 to −1° C.

17. The ink jet recording apparatus according to claim 15 wherein the solvent contains one or more solvents selected from the group consisting of polyols, alkanediols, glycol ethers, nitrogen-containing solvents, and combinations thereof.

18. The ink jet recording apparatus according to claim 15 wherein the resin particles include resin particles formed from a (meth)acrylic resin.

19. The ink jet recording apparatus according to claim 18 wherein the resin particles contain a (meth)acrylic-vinyl copolymer resin, and a constituent ratio of vinyl monomer in the (meth)acrylic-vinyl copolymer resin is 20 to 65% by mass.

20. The ink jet recording apparatus according to claim 15 wherein an average particle diameter of the resin particles is 150 to 300 nm.

* * * * *